US007174898B2

(12) United States Patent
Bosman

(10) Patent No.: US 7,174,898 B2
(45) Date of Patent: Feb. 13, 2007

(54) APPLICATOR DEVICE FOR COSMETIC CONTAINERS

(76) Inventor: Marsha Gail Bosman, 7860 Hillside Ave., Corona, CA (US) 92881

( * ) Notice: Subject to any disclaimer, the term of this patent is extended or adjusted under 35 U.S.C. 154(b) by 456 days.

(21) Appl. No.: 10/732,010

(22) Filed: Dec. 11, 2003

(65) Prior Publication Data

US 2005/0129452 A1 Jun. 16, 2005

(51) Int. Cl.
*A45D 40/26* (2006.01)

(52) U.S. Cl. ..... 132/218; 401/121

(58) Field of Classification Search ..... 401/118, 401/121, 122, 126, 127; 132/218, 313
See application file for complete search history.

(56) References Cited

U.S. PATENT DOCUMENTS

| | | | | |
|---|---|---|---|---|
| 3,694,096 | A | 9/1972 | Seidler | |
| 3,741,666 | A | 6/1973 | Vasas et al. | |
| 4,219,983 | A | 9/1980 | Kern et al. | |
| D270,768 | S | 9/1983 | Cassai et al. | |
| 4,984,920 | A | 1/1991 | O'Neill | |
| 5,328,282 | A | 7/1994 | Charrier et al. | |
| 6,168,334 | B1 * | 1/2001 | Fordham | 401/122 |
| 6,676,320 | B1 * | 1/2004 | Wainer | 401/122 |
| 2004/0170463 | A1 * | 9/2004 | Beretta | 401/122 |

* cited by examiner

*Primary Examiner*—Todd E. Manahan
*Assistant Examiner*—Rachel A. Running
(74) *Attorney, Agent, or Firm*—Theresa M. Seal

(57) ABSTRACT

The present invention relates to an improved applicator device for liquid and semi-liquid products. In particular, this invention relates to an improved applicator device for cosmetic products, such as mascara that eliminates the build-up and subsequent loss of product, resulting in reduced cost through use of a greater percentage of the product stored in the bottle. The improved applicator includes a handle, a shaft, and an applicator brush attached to the end of the shaft for insertion in a product container holding a liquid or semi-liquid product. Attached to the shaft is a sliding collar that is interconnected to a wiper. When the applicator is withdrawn from the product container, the collar is retracted, and this closes the wiper radially about the shaft of the applicator. Residue liquid remains on the inside wall of the container. When the applicator is partially inserted back into the container the collar is slidably moved downward on the shaft. This causes the wiper to radially open so that the wiper presses against the inside wall of the container. As the brush is fully inserted within the container, the open wiper sweeps any residue liquid down into the container with the unused liquid product.

12 Claims, 4 Drawing Sheets

APPLICATOR DEVICE FOR COSMETIC CONTAINERS

FIELD OF THE INVENTION

The present invention relates to an improved applicator device for liquid and semi-liquid products. In particular, this invention relates to an improved applicator device for cosmetic products, such as mascara, for extending the life of the liquid or semi-liquid product contained therein.

BACKGROUND OF THE INVENTION

Mascara tubes typically utilize a plastic bottle containing a small volume of a solid-liquid slurry that is applied to eyelashes to define and enhance their appearance. The mascara is applied using a small spiral brush, curved to conform to the shape of the lashes, for enhancing the look and appearance of the lashes. When not in use, the brush is stored in the bottle, with a screw cap to provide an airtight seal. This cap prevents leakage from the bottle and minimizes contact with air, which will dry and harden the mascara. The brush, while in the bottle, is partially in contact with the mascara. When the brush is removed for use, the brush will contain an excess of mascara that cannot be applied to the lashes. The excess is removed by passing the brush through a rubber constriction at the entrance to the bottle. The excess mascara collects underneath the rubber constriction. Over time, the mascara that collects under the constriction dries and becomes unusable. As a result, the container must be discarded before the entire amount of the product has been utilized.

Thus, the prior art discloses a number of applicators and dispensers that attempt to minimize the wastage of mascara.

For example, the Seidler patent (U.S. Pat. No. 3,694,096) discloses a powder or cream dispenser that includes a reciprocable plunger mounted within a holder, and the plunger includes an applicator at its distal end. The plunger permits the applicator to contact dispensable material held within the reservoir of a casing so that the bulk of the material is dispensed therefrom.

The Vasas et al. patent (U.S. Pat. No. 3,741,666) discloses a cosmetic applicator that includes an adjustable brush reciprocably movable within the body of the applicator by a plunger seated within a cylindrical sleeve. The brush is adjustable by sliding the brush in either direction within the sleeve.

The Buckley et al. patent (U.S. Pat. No. 4,219,283) discloses a container having a telescoping brush or applicator wherein the applicator is attached to two telescoping members one of which is mounted to the cap of the dispensing container.

The Cassai et al. design patent (U.S. Pat. No. des. 270,768) discloses a retractable cosmetic applicator wherein the brush is able to retract in a linear and axial direction with respect to the cap.

The O'Neill patent (U.S. Pat. No. 4,984,920) discloses a closure assembly having an axially movable applicator for reaching the bottom of the container. The applicator is mounted to a stem that is axially movable within a partially threaded sleeve, and the sleeve is mounted to an adjuster cap.

The Charrier et al. patent (U.S. Pat. No. 5,328,282) discloses a mascara bottle and applicator wherein the brush is attached to a rod having a pivotal segment that allows the brush to sweep and collect mascara from the enlarged circular base of the mascara bottle.

Nonetheless, despite the ingenuity of the above devices, there remains a need for an applicator device that minimizes the wastage of the product and extends the usable life of the mascara contained therein.

SUMMARY OF THE INVENTION

The present invention comprehends an applicator device for mascara containers and includes a handle having a shaft mounted thereto and extending outwardly therefrom. An applicator brush is mounted at the distal end of the shaft. A slidable collar is mounted on the shaft and is actuated for movement between a retracted position and a use position by a manually operable slide button connected to the collar. Mounted to the shaft and located between the applicator brush and the collar is a wiper. The wiper is interconnected to the collar so that the wiper can be selectively radially spread or opened around the shaft and closed against the shaft. In order to remove the applicator brush from the mascara tube or container holding the mascara, and in order for the brush to pass through the tube opening and the annular constriction adjacent the opening, the slide button is moved rearward to the retracted position. This causes the wiper to close about the shaft so that the brush can be removed for applying mascara to the eyelashes. After application of the mascara, the user would insert the brush back into the mascara tube. When the brush passes by the annular constriction the individual would then manually push the slide button downward to radially spread the wiper within the tube for sweeping mascara down from the inner surface of the tube. After the applicator brush is fully inserted within the tube, the slide button would be retracted for closing the wiper.

It is an objective of the present invention to provide an applicator device for mascara and other cosmetic tubes and containers that minimizes the drying and clumping of the mascara or other cosmetics within the container or tube.

It is another objective of the present invention to provide an applicator device that minimizes the amount of clumped and thickened mascara in the container thereby preventing the eyelashes from falling out from excessive rubbing by the brush to remove thickened mascara from the eyelashes.

It is yet another objective of the present invention to provide an applicator device that is able to push the mascara or other cosmetics down from the inside surface of the tube or container for intermixing it with the material at the container bottom so that the mascara or other cosmetic remains moist and usable.

It is still another objective of the present invention to provide an applicator device that minimizes and reduces the amount of coagulation and drying of mascara or other cosmetics within the tube or container by sweeping mascara or other cosmetics from the inside surface of the tube or container down into the tube.

Still yet another objective of the present invention is to provide an applicator device that extends the life of the mascara or other cosmetics by keeping all the mascara or other cosmetics within the tube or container in a fresh and usable state.

A still further objective of the present invention is to provide an applicator device that avoids the irritation of the eyes during mascara application by preventing the clumping and coagulation of the mascara within the tube or container.

These and other objects, features and advantages will become apparent upon a perusal of the following detailed description when read in conjunction with the following drawings and appended claims.

DETAILED DESCRIPTION OF THE PREFERRED EMBODIMENT

Figure 1:
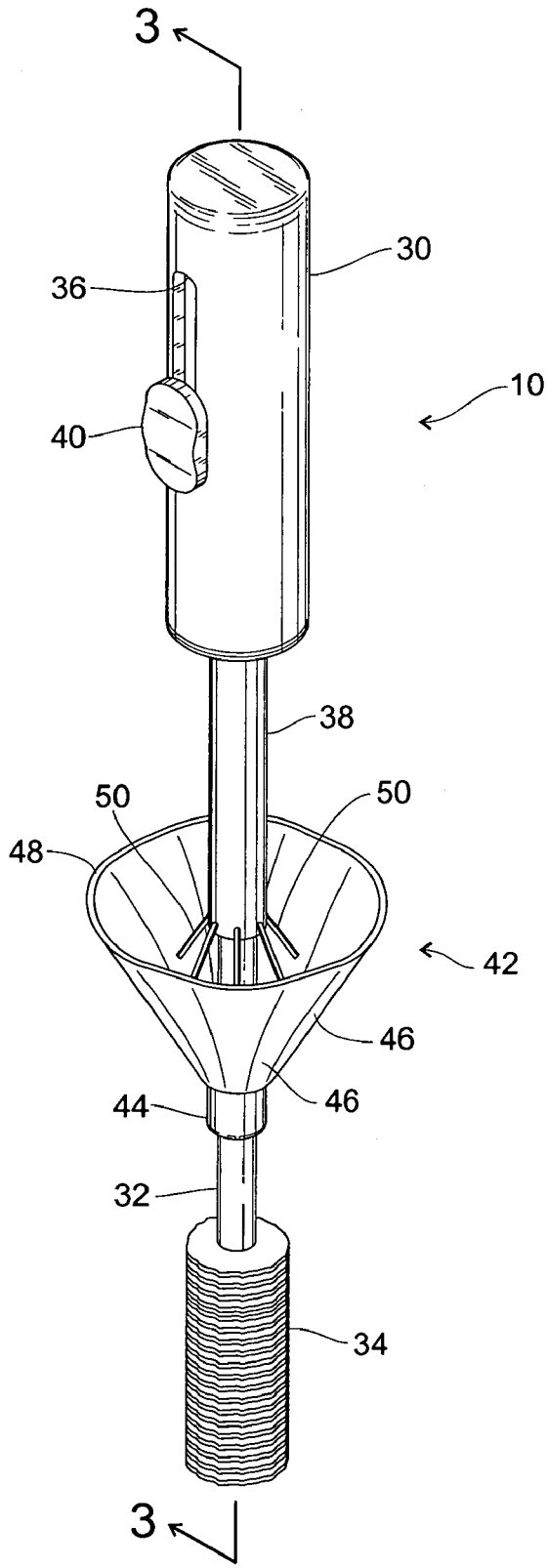
FIG. 1 is a perspective view of the applicator device of the present invention illustrating the wiper radially disposed in the use disposition.
Figure 2A:
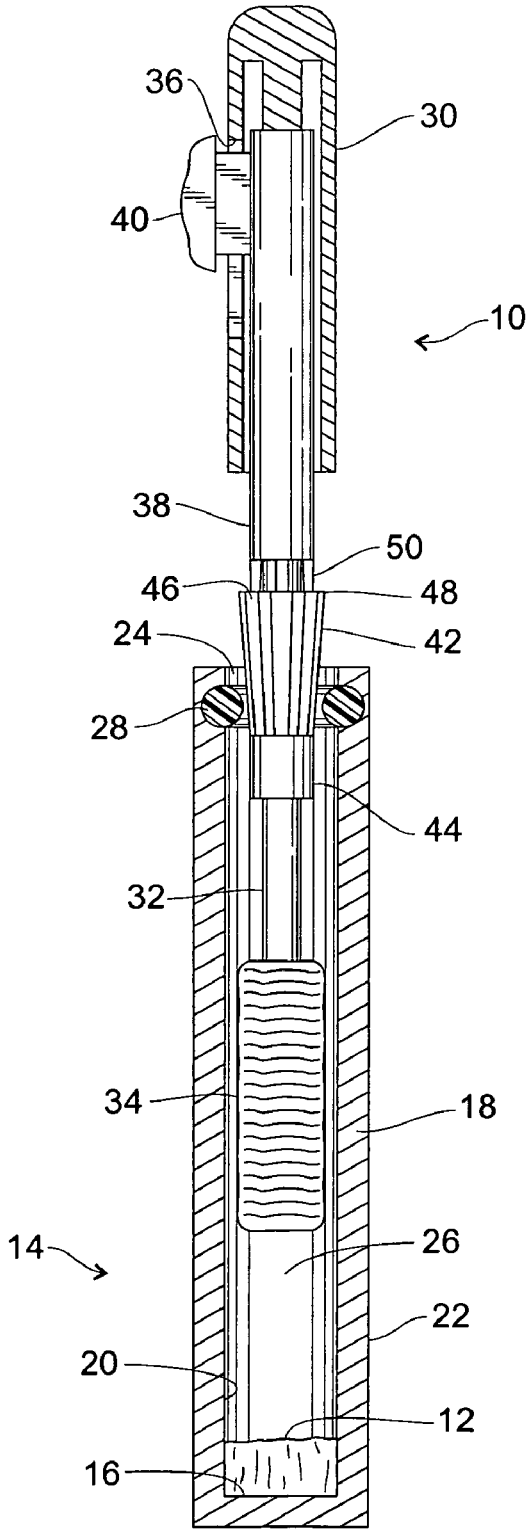
FIG. 2A is a side elevational view of the applicator device illustrating the retraction of the slide button for closing the wiper so that applicator brush can be removed for use.
Figure 2B:
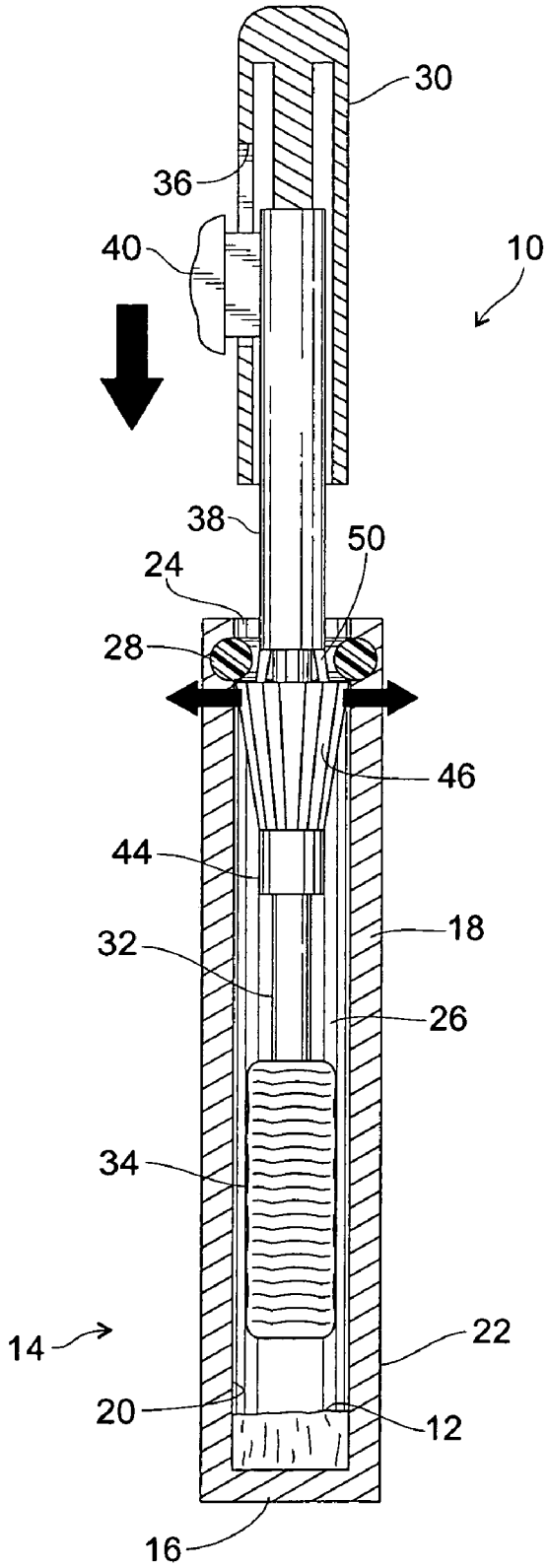
FIG. 2B is a side elevational view of the applicator device illustrating the insertion of the brush within the mascara or other cosmetic tube and the downward positioning of the slide button for radially opening the wiper so that mascara or other cosmetic can be swept down into the tube.
Figure 3:
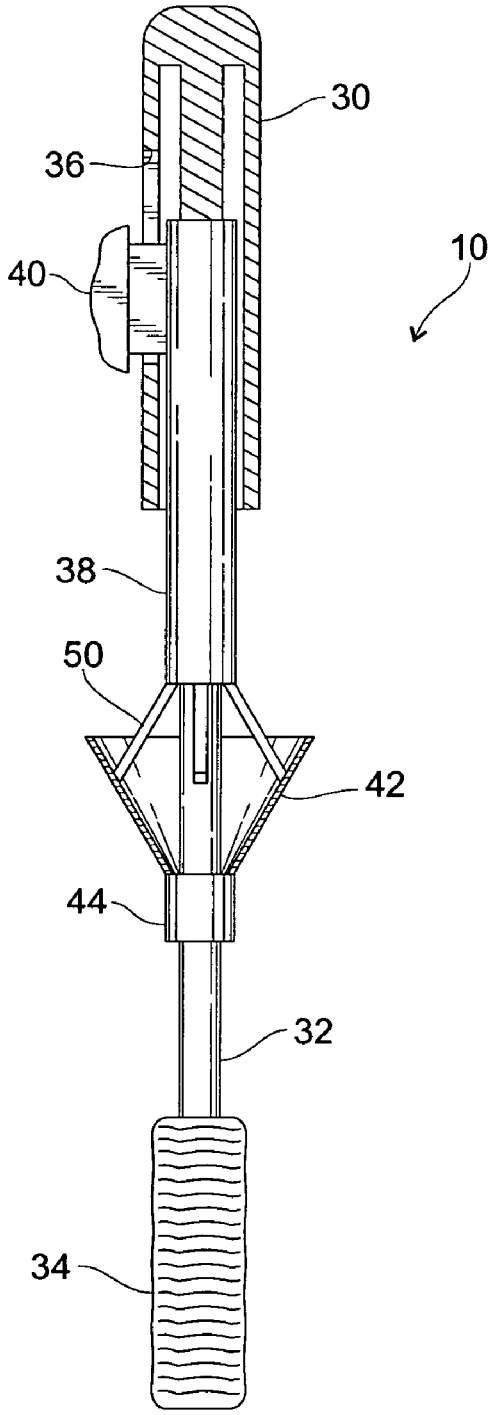
FIG. 3 is a side elevational view of the applicator device illustrating the radial spreading of the wiper to the fully open disposition.

Illustrated in FIGS. 1–3 is an applicator device for dispensing and applying a liquid or a semi-liquid product from a tube or container within which the applicator device is at least partially inserted. More specifically, the applicator device of the present invention is an applicator device 10 for dispensing and applying a cosmetic product, such as mascara 12, from a mascara tube or container 14. The mascara tube or container 14 is generally of an elongated, cylindrical form and includes a bottom wall 16 and an annular side wall 18 with the side wall 18 having inside 20 and outside 22 surfaces. The mascara container 14 further includes an opening 24 through which the applicator device 10 passes for removing the applicator device 10 for use and for returning the applicator device 10 when not in use. The sidewall 18 defines an interior chamber 26 for holding therein the product such as mascara 12. Adjacent the opening 24 is a constriction generally in the form of an annular rubber seal 28.

As shown in FIGS. 1–3, the applicator device 10 includes a handle 30, and mounted to the base of the handle 30, and extending axially and longitudinally therefrom is a shaft 32. The shaft 32 is longer than the handle 30 and an annular gap extends between that portion of the shaft 32 that is encompassed by the handle 30. Mounted at the distal end of the shaft 32 is an applicator brush 34 for collecting the mascara 14 so that the mascara 14 can be applied to the eyelashes. The handle 30 also includes a slot 36 whose function will be hereinafter further described.

As shown in FIGS. 1–3, a cylindrical collar 38 is mounted on the shaft 32 for slidable, linear, reciprocable movement thereon. The collar 38 is an elongated tubular structure having a bore extending longitudinally therethrough. A thumb operated slide button 40 is attached to the collar 38 and extends laterally therefrom and outwardly through the slot 36 so that the individual can manually manipulate the slide button 40 for moving the collar 38 along the shaft 32. The length of the slot 36 delimits the length of travel of the collar 38 on the shaft 32. The slide button 40 is retracted when it is moved toward the base of the handle 30; and the slide button 40 is in the open disposition when it is moved downward on the handle 30.

Illustrated in FIGS. 1–3 is a wiper 42 that is able to push and sweep mascara 12 from the inside surface 20 of the tube side wall 18 down within the interior chamber 26 toward the bottom wall 16 of the container 14 for maintaining the mascara 12 in a generally mixed and moist state. The wiper 42 is an umbrella-like structure that is fixed in place on the shaft 32 by an anchor 44 with the anchor 44 being secured to the shaft 32 between the applicator brush 34 and the collar 38. The wiper 42 includes a plurality of ribs 46 that are radially disposed about the shaft 32, and the wiper 42 is capable of being selectively radially opened about the shaft 32 and radially closed against and on the shaft 32. The ribs 46 may include a flexible membrane that is attached to the peripheral rim 48 of the wiper 42. The membrane would surround the shaft 32 and radially deploy to the open and closed position concomitant with the deployment of the wiper 42. The purpose of the membrane would be to prevent the accumulation of mascara 12 in the conical interior of the wiper 42 adjacent the area where the wiper 42 is joined to the anchor 44. While the ribs 46 that comprise the wiper 42 are generally rigid structures, the ribs 46 are able to move between an angle of 0 degrees wherein the ribs 46 are radially closed on the shaft 32 and disposed perpendicular thereto and 90 degrees that represents the ribs 46 in their radially open and deployed position as shown in FIG. 1.

As shown in FIGS. 1 and 3, the collar 38 is interconnected to the ribs 46 of the wiper 42 by a plurality of spreader arms 50 so that there is one spreader arm 50 for each rib 46. The spreader arms 50 are pivotally or hingably attached at their respective opposed ends to the collar 38 and each individual rib 46. Thus, retraction of the slide button 40 causes the retraction of the collar 38, and this movement causes the ribs 46 and spreader arms 50 to pivot downward until they are disposed flush against the shaft 32. When the slide button 40 is manually pushed in the opposite direction downward toward the brush 34, the slidable movement of the collar 38 causes the spreader arms 50 to pivot upward away from the shaft 32 thereby spreading the ribs 46 and disposing the wiper 42 to the radially open position. It should be noted that the wiper 42 is configured so that when the wiper 42 is in the fully open position, as shown in FIGS. 1 and 3, the diameter of the peripheral rim 48 of the wiper 42 is at least equal to the diameter of the inside surface 20 of the side wall 18 of the mascara tube or container 14.

To operate the applicator device 10, the individual would remove the applicator device 10 from the tube 14 with the slide button 40 in the retracted position. In the retracted position, the diameter of the wiper 42 will be less than that of the rubber constriction 28, and the applicator device 10 can thus be easily removed. After use of the applicator brush 34 on the individual's eyelashes, the applicator device 10 is returned to the tube 14 with the wiper 42 still in the retracted position. The applicator device 10 is then inserted in the tube 14 until the brush 34 is fully inserted within the chamber 26 of the tube 14 so that the peripheral rim 48 of the wiper 42 is able to clear the constriction and pass immediately below the inner edge of the rubber seal 28 adjacent the opening 24 of the tube 14. The wiper 42 is then radially opened within the chamber 26 of the tube 14 by the individual moving the slide button 40 down thus causing the collar 38 to slide downward on the shaft 32 thereby opening the rim 48 of the wiper 42 and forcing the rim 48 against the inside surface 20 of the tube 14. While maintaining the wiper 42 in the radially open position, the applicator device 10 is then inserted the rest of the way into the tube 14. The excess mascara that has collected on the inside edge of the rubber constriction 28 is forced down into the tube 14 by the downward movement of the open wiper 42. The mascara can be reused as it is intermixed with mascara 12 that is already deposited within the chamber 26 of the tube 14. The wiper 42 is then closed by retracting the slide button 40 after the applicator device 10 has been fully inserted within the chamber 26 of the mascara tube 14.

Having thus described certain embodiments of the present invention, various alterations, modifications and improvements will become apparent to those of ordinary skill in the art. Such alterations, modifications and improvements are intended to be within the spirit and scope of the present invention, and accordingly are included within the scope of the appended claims.

I claim:

1. An applicator device for applying liquid or semi-liquid products from a container having the product stored therein, the device comprising:

a cylindrical shaft having a proximal end and a distal end, the proximal end having a handle attached thereto, and the distal end having an applicator;

a tubular sliding collar having an elongated bore slidably coupled with the shaft and designed for longitudinal movement along the shaft; and a deformable wiping means associated with the sliding collar, wherein the wiping means is flush with the shaft when the sliding collar is retracted and wherein the wiping means projects outward from the shaft when the sliding collar is extended.

2. The applicator device for applying liquid or semi-liquid products from a container of claim 1 wherein the deformable wiping means comprises an anchor connected to the shaft at a point above the applicator and extending around the circumference of the shaft;

a plurality of ribs with an anchor end and an opposite end, the anchor end of the ribs pivotally connected to the anchor;

a plurality of spreader arms with a collar end and a rib end, the collar end of the spreader arms pivotally connected to sliding collar and the rib end of the spreader arms pivotally connected to the ribs, so that when the sliding collar is retracted the ribs and the spreader arms form substantially straight units laying flat and parallel to the shaft and when the sliding collar is extended the ribs extend perpendicular to the shaft at a maximum 90 degree angle to the shaft; and a flexible umbrella membrane attached to the anchor and the sliding collar and completely covering the ribs and spreader arms with the umbrella membrane being capable of expanding and contracting as the slider is extended and retracted.

3. The applicator device for applying liquid or semi-liquid products from a container of claim 2 wherein the umbrella membrane is composed of rubber.

4. The device for applying liquid or semi-liquid products from a container of claim 1 wherein an applicator brush is used to apply the product.

5. The applicator device for applying liquid or semi-liquid products from a container of claim 1 wherein a sponge is used to apply the product.

6. The device for applying liquid or semi-liquid products from a container of claim 1 wherein the wiping means, when extended, has a diameter that is at least equal to the inside surface of the product container.

7. An applicator device for sweeping mascara from the inside surfaces of the mascara container down into the chamber of the mascara container, comprising:

a handle;

a shaft mounted to the handle and extending axially and longitudinally therefrom, the shaft having a distal end that is received within the chamber of the mascara container;

an applicator brush attached to the distal end of the shaft for applying mascara to the individual's eyelashes;

a collar slidably mounted on the shaft for linear movement thereon;

a slide button mounted on the collar and projecting from the shaft for manual manipulation between a retracted position and an open position;

a wiper mounted on the shaft adjacent the applicator brush and interconnected to the collar and the wiper being movable between a radially open position so that the wiper can contact the inside surfaces of the mascara container and for sweeping mascara therefrom and a closed position flush against the shaft so that the applicator brush and wiper can be fully inserted within the chamber of the mascara container; and retraction of the slide button causes the collar to slide on the shaft away from the applicator brush thereby pivoting the wiper to radially close about the shaft and movement of the slide button in the opposite direction causes the collar to slide on the shaft toward the applicator brush pivoting the wiper to the radially open position so that after the wiper is inserted into the mascara container the wiper can be opened for sweeping mascara from the inside surfaces of the mascara container.

8. The applicator device of claim 7 further comprising a cylindrical anchor mounted to the shaft adjacent the applicator brush and to which the wiper is secured.

9. The applicator device of claim 8 wherein the wiper includes a plurality of ribs circumjacently arranged on the shaft and movable between the radially open position and the radially closed position when actuated by slide button.

10. The applicator device of claim 9 further comprising a plurality of spreader arms for interconnecting the collar to the ribs of the wiper with one spreader arm being connected to one rib.

11. The applicator device of claim 10 wherein each the spreader arm is pivotally attached to the collar and the respective rib for allowing the wiper to pivot so that the wiper can close against the shaft when the slide button is retracted and the wiper can expand and radially open when slide button is moved downward on the shaft toward the brush.

12. The applicator device of claim 11 wherein the wiper includes a peripheral rim so that when the wiper is fully expanded and opened the diameter of the peripheral rim is at least equal to the inside diameter of the chamber of the mascara container thereby allowing the wiper to contact the inside surfaces of the mascara container for sweeping mascara therefrom after the wiper has been opened within the chamber of the mascara container.

* * * * *